US006109271A

United States Patent [19]

Webber et al.

[11] Patent Number: 6,109,271

[45] Date of Patent: Aug. 29, 2000

[54] CIGAR HOLDER

[75] Inventors: Charles H. Webber, Troy, Mich.; Larry J. Winget, 1799 Fox Knoll, Leonard, Mich. 48038

[73] Assignee: Larry J. Winget, Leonard, Mich.

[21] Appl. No.: 09/075,497

[22] Filed: May 8, 1998

[51] Int. Cl.[7] ..... A24F 13/22; A24F 9/14; A24F 19/00

[52] U.S. Cl. ..... 131/240.1; 131/241; 131/257; 131/260

[58] Field of Search ..... 131/240.1, 241, 131/242, 242.5, 242.6, 257, 258, 259, 260

[56] References Cited

U.S. PATENT DOCUMENTS

| | | |
|---|---|---|
| 785,377 | 3/1905 | Poppert . |
| 1,439,351 | 12/1922 | Alsip et al. . |
| 1,485,223 | 2/1924 | Greene . |
| 1,802,332 | 4/1931 | Burns . |
| 1,840,210 | 1/1932 | Reekers . |
| 1,876,299 | 9/1932 | Honigbaum . |
| 2,539,276 | 1/1951 | Schmeling . |
| 2,588,208 | 3/1952 | Connellan . |
| 2,617,429 | 11/1952 | Smereck . |
| 2,639,718 | 5/1953 | Leong . |
| 2,647,523 | 8/1953 | Vollender, Jr. . |
| 2,663,301 | 12/1953 | Bachman, Sr. . |
| 2,777,449 | 1/1957 | Foster . |
| 2,785,686 | 3/1957 | Terney . |
| 5,586,509 | 12/1996 | Mangold et al. . |

*Primary Examiner*—Christopher A. Fiorilla
*Attorney, Agent, or Firm*—Brooks & Kushman P.C.

[57] ABSTRACT

A cigar holder for a vehicle is formed with one portion to support a cigar and another portion of non-heat conducting and weather resistant material to protect the vehicle from the heat of the cigar and the cigar holder from the deleterious effects of the weather. The cigar holder is attachable to the vehicle by a suction cup which is concealed by an insert which is selectable to give the cigar holder different appearances.

4 Claims, 1 Drawing Sheet

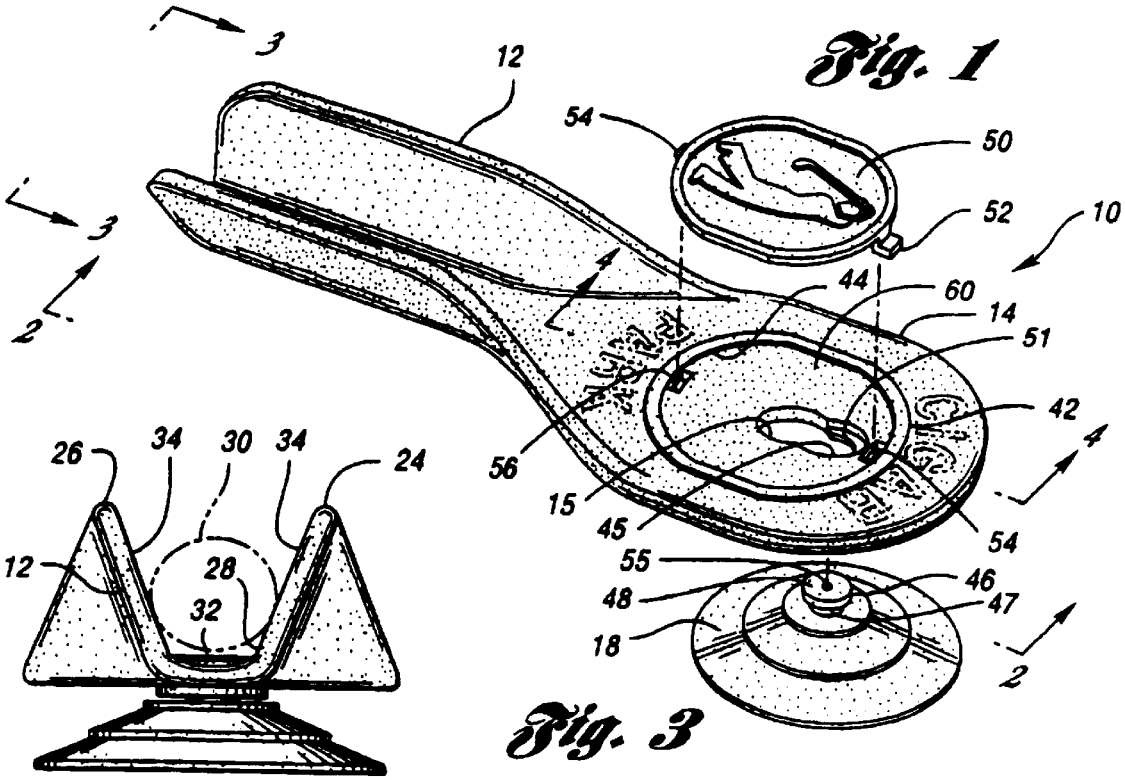
Fig. 1
Fig. 3
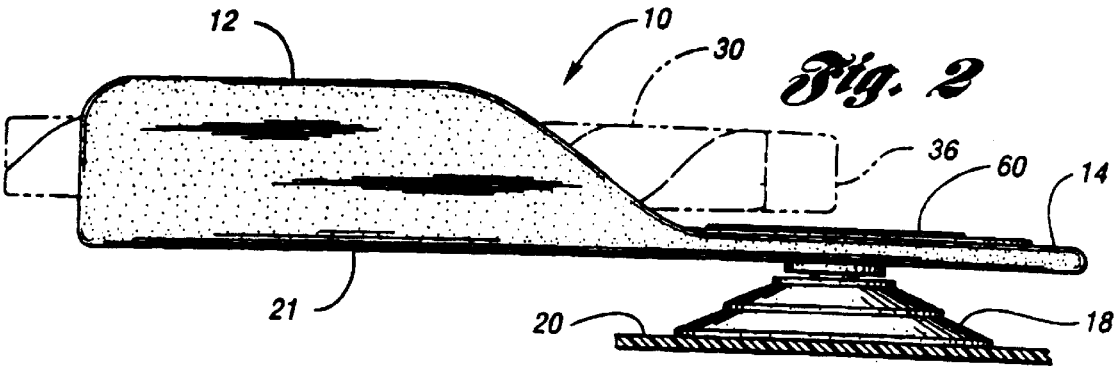
Fig. 2
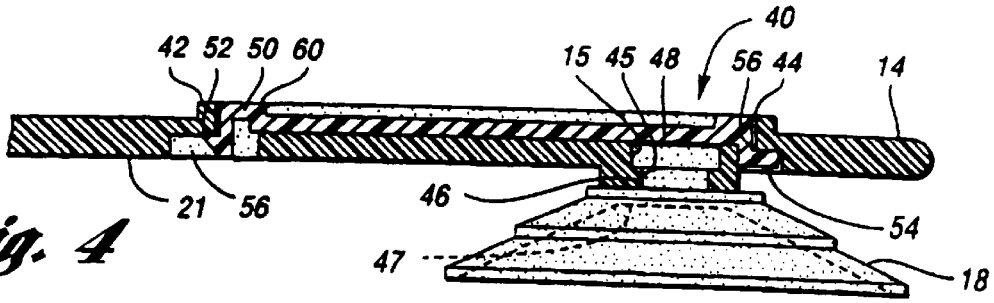
Fig. 4

CIGAR HOLDER

TECHNICAL FIELD

This invention relates to devices for supporting cigars which are formed of non-heat conductive material to protect a surface on which the device is mounted.

BACKGROUND ART

U.S. Pat. No. 1,876,299 to H. H. Honigbaum issued Sep. 6, 1932 and describes a holder for cigars or cigarettes which is made of metal with extended spring tongues to grip the cigar or cigarette.

U.S. Pat. No. 2,539,276 to E. R. Schmeling issued Jan. 23, 1951 and describes a holder for cigarettes which is made of metal and consists of apertures in metal flanges that hold cigarettes in an upright position. The invention further consists of a suction cup to attach the holder to a surface.

U.S. Pat. No. 2,617,429 to A. Smereck issued Nov. 11, 1952 and describes a holder for cigars or cigarettes that consists of a trough portion that may be attached to an ashtray by L-shaped clamps.

U.S. Pat. No. 2,663,301 to H. L. Bachman, Sr. issued Dec. 22, 1953 and describes a cigarette holder and extinguishing device that consists of a tray and a tubular sleeve into which the burning end of a cigarette is placed to extinguish the cigarette.

DISCLOSURE OF THE INVENTION

The invention is a cigar holding device or cigar holder that supports a cigar having a lighted tip in juxtaposition to a surface. The cigar holding device has a support portion that is configured to grippingly engage the cigar. The cigar holding device also has a heat barrier portion that is constructed of a non-heat conductive material that is configured to lay between the burning end of the cigar and the surface. The purpose of the heat barrier portion is to protect the surface from heat damage or burns when the cigar is grippingly engaged by the support portion of the cigar holding device. The cigar holding device is attachable to a vehicle surface or the like by a one-piece suction cup or the like. The suction cup is connected to the cigar holding device by a fastener portion which is snapped into position and concealed behind an insert in the heat barrier portion of the cigar holder. The insert is removable and replaceable by other inserts having different appearance characteristics and/or logos.

Accordingly, it is an object of the present invention is to provide an improved cigar holder that may be used while driving a vehicle to protect the driver and the vehicle.

Another object of this invention is an improved cigar holder to reasonably hold a cigar in a relatively level manner so that it is not necessary to hold or place the cigar on the ground while involved in outside activities such as boating, snowmobiling, etc., whereby to allow the cigar to be kept clean and dry, and from chemical contaminants, used in the maintenance of the ground or other outside surfaces.

A further object of this invention is to provide a thermal heat barrier for the cigar holder of the foregoing object, whereby to prevent possible burn or heat damage to the surface of the vehicle, where the cigar holding device is mounted.

A further object of this invention is to provide an improved cigar holder that is non-heat conductive and weather resistant.

A still further object of this invention is to provide an improved cigar holder with an attachment arrangement which includes a selectable and replaceable insert to conceal an attachment device and provide a selectable appearance for the holder.

A more specific object of this invention is a cigar holder for supporting a cigar which locates a lighted tip in juxtaposition to a surface and has a support portion configured to grippingly engage the cigar; and a heat barrier portion formed of non-heat conductive material; and in which the heat barrier portion is configured to lay between the lighted tip of the cigar and the surface and is of sufficient expanse when the cigar is grippingly engaged by the support portion to protect the surface from the heat of the lighted tip; and in which the cigar holder includes an attachment device disposed adjacent the heat barrier portion which includes a connector concealed by a selectable and replaceable appearance insert in the heat barrier portion.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 1 is an exploded perspective view of the cigar holder;

FIG. 2 is a side elevational view of the cigar holder on a surface with a cigar shown in phantom;

FIG. 3 is an end view taken in the direction 3—3 of FIG. 1 with a cigar shown in phantom; and FIG. 4 is an enlarged, fragmentary, cross-sectional view of an attachment device for the cigar holder taken along the line 4—4 in FIG. 1 to show an insert concealment arrangement for the attachment device.

DETAILED DESCRIPTION OF THE PREFERRED EMBODIMENT

Referring to the drawings in detail, there is depicted in FIGS. 1 and 2 a cigar holding device or cigar holder identified by the numeral 10. The cigar holder is made up of a holding or cigar support portion 12, and a heat barrier portion 14. The support portion 12 and heat barrier portion 14 are integrally formed of a heat-resistant plastic material that is molded to the generally V-shape of the support portion of the cigar holder 10. Suitable material may be phenolic or high heat acrylonitrile/ butadiene/styrene copolymer (ABS).

A suction cup 18 may be formed from PVC and attached centrally to the heat barrier portion 14 to facilitate attachment of the cigar holder to a surface 20 of a vehicle for example. Another means for attaching the cigar holding device may be adhesive such as pressure-sensitive tape with an adhesive agent suitable for bonding to the mounting surface 20 of the vehicle or the like. The adhesive may be attached along the bottom 21 of the support portion centrally thereof 12 to permanently affix the cigar holder 10 to the surface 20 of the vehicle or the like if it is so desired.

Reference is now made to FIGS. 2 and 3 which depict side and end views of the cigar holder. The support portion 12 consists of two walls 24, 26 that diverge to form a trough 28 to facilitate the gripping engagement of a cigar 30 shown in phantom on FIGS. 2 and 3. The two walls 24,26 are displaced at an angle in the range of 45 to 55° from the bottom 32 of the support portion 12. The gripping ability of the support portion 12 is enhanced by a roughened portion of an injection mold so that the inside surfaces 34 of the walls 24, 26 formed by the mold portion are like a #200 grade sandpaper. The surface on both inside walls for the length of the trough shown on FIGS. 1 and 3 will have a gripping surface consisting of rough texture which create a gripping action. When the cigar 30 is grippingly engaged by the support portion 12, a lighted tip 36 of the cigar is disposed above the heat barrier portion 14 which is interposed between the lighted tip and surface 20 and of sufficient expanse when the cigar is grippingly engaged by the support portion to protect the surface 20 from the heat of the lighted tip.

The cigar holder is preferably formed of a plastic material such as aforesaid which has significant heat resistant or non-heat conducting properties, and is formable in a molding, extrusion or pressing process to form the V-shaped walls 24, 26, and gripping surfaces 34 of the cigar holder 10 and/or any raised lettering such as the trademark "CIGAR PARK" thereon. A suitable thickness for the support portion 12 and the heat barrier portion 14 is 3.5 mm.

With reference to FIGS. 1 and 4, the suction cup 18 or other attachment device is shown with a concealment arrangement 40. Concealment is achieved by a peripheral rib 42 in the heat barrier portion 14 which defines a recess 44 having a pocket 45 formed at one end of a figure-8 shaped hole 15 in the heat barrier portion. The suction cup is held to the heat barrier portion 14 by a resilient mushroom-like head or fastener portion 46. The head portion extends from the suction cup so that its top 48 is trapped in the pocket 45 of the recess 44 and substantially flush with the top of the pocket. The head portion 46 is connected to the cup portion of the suction cup 18 by a neck portion 47 which is slightly larger than the narrowed waist of the figure-8 shaped hole 15. To install the suction cup in the half barrier portion, the head portion 46 of the suction cup 18 is inserted through the enlarged end 49 of the figure-8 shaped hole 15. Then the head portion 46 is moved laterally in hole 15 until it snaps into the narrower end 51 of the figure-8 shaped hole at the pocket 45. The resilience of the neck portion of the mushroom-like configuration permits the neck portion to contract sufficiently to pass through the narrow waist of the hole 15. An insert 50 then covers the recess to conceal the mushroom-like head and thus the attachment device. To install the insert 50, a tang 52 on the insert is located in a hole 54 in the heat barrier portion 14 and pivoted downwardly into the recess 42. A cam-shaped barbed prong 54 snaps into a hole 56 in the heat barrier portion to retain the insert in place. A knob 55 on the head portion of the suction cup is compressed as the insert is snapped in place. Such compression tends to hold the insert snugly in place. The insert 50 may have an appearance finish 60 such as a sport figure and is selectable so that different logos or appearances may be achieved.

It is important that the suction cup 18 maintain its suction grip on surface 20. Accordingly, the mushroom-like head 46 and neck 47 are made integral with the suction cup to prevent leakage and loss of suction.

It is recognized that many modifications of this device may be made in the non-heat conductive materials used, the relative angles of the support portion, and the attachment means. We have set forth the preferred embodiment of the invention and we are aware that modifications can be made without departing from the spirit of the invention as defined by the following claims.

What is claimed is:

1. A cigar holding device for supporting a cigar having a lighted tip in juxaposition to a surface, said device comprising:

a support portion configured to grippingly engage the cigar;

a heat barrier portion formed of non-heat conductive material, said heat barrier portion configured to lay between the lighted tip of the cigar and the surface and of sufficient expanse when the cigar is grippingly engaged by the support portion whereby to protect the surface from the heat of the lighted tip; and an attachment device disposed adjacent said heat barrier portion and adapted to facilitate attachment to the surface, and wherein said heat barrier portion has a recess and said attachment device has a fastener portion in said recess, and including a selectable insert positionable in said recess over said fastener portion to conceal said fastener portion and having an appearance finish in accordance with the insert selected.

2. A cigar holding device for supporting a cigar having a lighted tip in juxaposition to a surface, said device comprising:

a support portion configured to grippingly engage the cigar;

an adhesive disposed adjacent said support portion centrally thereof and adapted to facilitate attachment to said surface; and a heat barrier portion formed of non-heat conductive material, said heat barrier portion configured to lay between the lighted tip of the cigar and the surface and of sufficient expanse when the cigar is grippingly engaged by the support portion, whereby to protect the surface from heat of the lighted tip.

3. A cigar holding device for supporting a cigar having a lighted tip in juxaposition to a surface, said device comprising:

a support portion configured to grippingly engage the cigar;

a heat barrier portion having a recess and formed of non-heat conductive material, said heat barrier portion configured to lay between the lighted tip of the cigar and the surface and of sufficient expanse when the cigar is grippingly engaged by the support portion whereby to protect the surface from the heat of the lighted tip; and an attachment device disposed adjacent said heat barrier portion and adapted to facilitate attachment to the surface, wherein said attachment device has a fastener portion in said recess, and including a selectable insert positionable in said recess over said fastener portion to conceal said fastener portion and having an appearance finish in accordance with the insert selected; and wherein said recess has a pocket with a figure 8-shaped opening to locate said fastener portion, and said fastener portion has a mushroom like resilient configuration sufficiently contractable to be pushed from one portion of said opening to another portion of said opening.

4. A cigar holding device for supporting a cigar having a lighted tip in juxaposition to a surface, said device comprising:

a support portion configured to grippingly engage the cigar;

a heat barrier portion having a recess and formed of non-heat conductive material, said heat barrier portion configured to lay between the lighted tip of the cigar and the surface and of sufficient expanse when the cigar is grippingly engaged by the support portion whereby to protect the surface from the heat of the lighted tip; and an attachment device disposed adjacent said heat barrier portion and adapted to facilitate attachment to the surface, wherein said attachment device has a fastener portion in said recess, and including a selectable insert positionable in said recess over said fastener portion to conceal said fastener portion and having an appearance finish in accordance with the insert selected; and wherein said fastener portion includes a compressible portion engageable by said insert when said insert is positioned in said recess whereby to compress said compressible portion sufficiently to hold said insert snugly in said cigar holding device.

* * * * *